United States Patent [19]

Goodale

[11] Patent Number: 4,757,564

[45] Date of Patent: Jul. 19, 1988

[54] MATTRESS HAVING COVER WITH MEMORY FABRIC

[75] Inventor: Clarke W. Goodale, Simi Valley, Calif.

[73] Assignee: American-National Watermattress Corporation, Anaheim, Calif.

[21] Appl. No.: 899,843

[22] Filed: Aug. 25, 1986

[51] Int. Cl.[4] ..... A47C 27/08

[52] U.S. Cl. ..... 5/451

[58] Field of Search ..... 5/451, 470, 471, 502, 5/448; 297/219, 229; 428/230, 231, 252, 229

[56] References Cited

U.S. PATENT DOCUMENTS

| | | | |
|---|---|---|---|
| 3,145,132 | 8/1964 | Seltzer | 428/230 |
| 3,183,868 | 5/1965 | Shotsky | 428/230 |
| 3,287,749 | 11/1966 | Marsico | 5/470 |
| 4,062,077 | 12/1977 | Autrey et al. | 5/451 |
| 4,187,567 | 2/1980 | Crowther | 5/451 |

FOREIGN PATENT DOCUMENTS

| | | | |
|---|---|---|---|
| 1451955 | 10/1976 | United Kingdom | 5/482 |

*Primary Examiner*—Alexander Grosz

*Attorney, Agent, or Firm*—Richard L. Myers

[57] ABSTRACT

A mattress includes a resilient member having an original size and shape and properties for compressing under the weight of a person lying on the mattress to a second size and shape. A mattress cover enveloping the resilient member includes a top panel having a memory fabric with particular stretch characteristics for expanding to the second size and shape when the person is lying on the mattress, and particular retention characteristics for returning to the original size and shape when the person is removed from the mattress. The memory fabric is especially desirable in avoiding the "hammock effect" in hybrid watermattress constructions.

17 Claims, 1 Drawing Sheet

MATTRESS HAVING COVER WITH MEMORY FABRIC

BACKGROUND OF THE INVENTION

1. Field of the Invention

This invention relates generally to mattresses, both water mattresses and box spring mattresses, having mattress covers including fabrics with improved stretch and memory characteristics.

2. Discussion of the Prior Art

One of the most persistent problems of the mattress industry has been associated with the stretch characteristics of the fabric used in mattress covers. Since a mattress cover is placed under tension by a person resting on the mattress, eventually the cover begins to stretch from its original flat shape to a hollow shape associated with a person lying on the mattress.

This hollow shape is most noticeable after a person is removed from a bed and the mattress cover tends to define the cavity where he was sleeping. The mattress appears as if the person were still lying on the bed. After the fabric has stretched, it tends to form bunches and wrinkles beneath the sheets of the bed. This is particularly annoying to a person when he returns to the bed and find himself lying on these bunches and wrinkles.

This characteristic of conventional mattress covers is particularly annoying in the case of a waterbed. In order to achieve the significant comfort associated with a flotation system, it is necessary that a person be permitted to sink, at least to some extent, into the watermattress. With conventional watermattress covers, this sinking tends to be inhibited by a fabric which does not stretch as much as it needs to to achieve the full flotation effect.

When the mattress cover lends more support than the water bladder there tends to be a "hammock effect" which reduces the desirable flotation characteristics. Thus, mattress covers associated with waterbeds are called on to stretch even further than those associated with interspring mattresses. It follows that the tendency to develop unsightly body cavities over time is even greater. Of course, in this environment, the adverse effect of the body cavities is even more noticeable.

The fabrics used in mattress covers of the past have included damask and polyester knits. These fabrics have not had any properties for returning to their original shape once they have been stretched. Nor have they had any properties for providing increased stretching in order to inhibit the hammock effect associated with watermattresses. Although these fabrics are fairly heavy and rigid, attempts of the prior art to solve the stretching problem have been directed toward making the fabrics even more rigid. In at least one case, nylon monofiliment has been woven into a half inch mesh which has been glued to the fabric in order to inhibit its stretching. In the case of waterbeds, a more rigid mattress cover has only increased the undesirable hammock effect. There have been no attempts to produce a fabric for mattress covers which accommodate stretching while a person is lying on the bed but has memory characteristics for returning to its original flat shape after a person is removed from the bed.

It has been desirable to include at least one inch of polyurethane foam or polyester fiber in the mattress cover in order to achieve a highly quilted and soft appearance. It has been found, however, that the adverse effects associated with fabric stretching have been even more pronounced when the thicker foams and fibers have been used in the mattress cover.

The industry has suffered from many returned products based on these adverse characteristics of the prior art. Attempts have been made to resew the mattress covers in order to eliminate the wrinkles, but of course this is a timely and aggravating process for both the consumer and the manufacturer.

SUMMARY OF THE INVENTION

In accordance with the present invention, a mattress cover is provided with a particular fabric which has both increased stretch characteristics, and increased memory characteristics. The memory characteristics enable the mattress cover to return to its generally flat shape each time a person is removed from the bed. Thus there is no bunching or wrinkling to provide an unsightly appearance or uncomfortable sleeping surface.

While the prior art has focused on inhibiting any stretching of the fabric in order that it might retain the desired flat shape, the concept of the instant invention encourages that stretching but also provides for memory characteristics which return the fabric to the desired flat shape.

In the case of watermattresses, the increased stretch characteristics enable the person lying on the mattress to sink into the water bladder sufficiently to achieve the desired flotation characteristics. In other words, the hammock effect is substantially eliminated. When this person arises from the bed the memory characteristics return the mattress cover to its substantially flat configuration completely devoid of the bunches and wrinkles associated with the prior art.

In accordance with the present invention, thicker foams can be used in the mattress cover to provide a very soft and attractive quilted appearance. The stretch characteristics of the fabric enable the foam to expand to full width in close proximity to the stitching to decrease the width of valleys in the quilting and increase the area of the plateaus.

Fabrics associated with the prior art have been printed with pigment paints which tend to flake when they are stretched. The fabric of the present invention can be imprinted with heat transfer methods which not only accommodate stretching but also provide enhanced fabric appearance.

These and other features and advantages associated with the present invention will be more apparent from a description of the preferred embodiments and referenced to the associated drawings.

DESCRIPTION OF PREFERRED EMBODIMENTS

Figure 1:
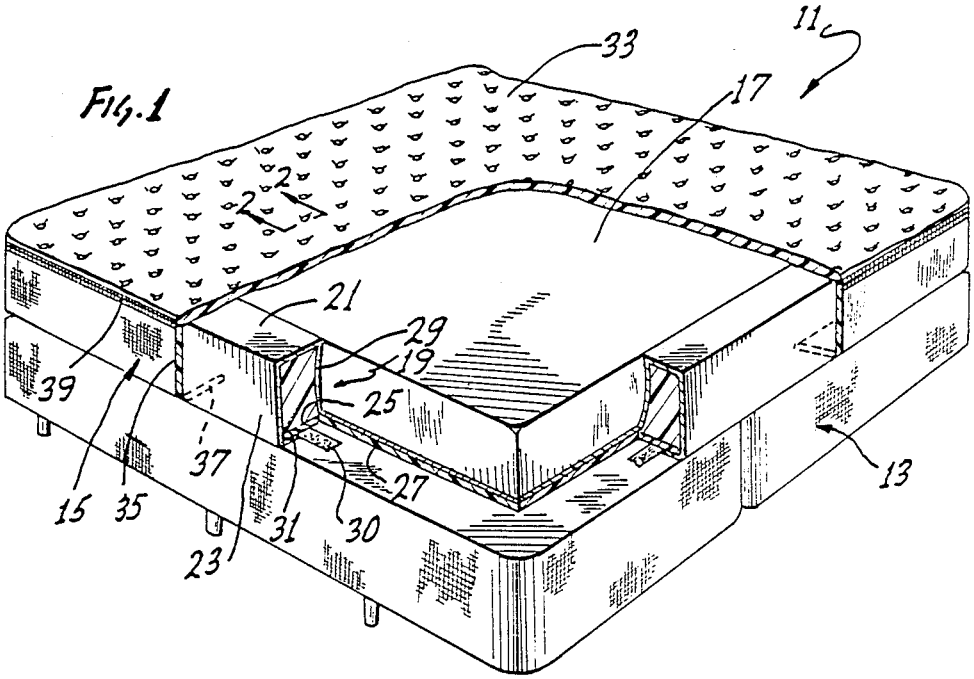
FIG. 1 is a perspective view of a waterbed partially in phantom and illustrating a watermattress having a mattress cover associated with the present invention.

A waterbed is illustrated in FIG. 1 and designated generally by the reference numeral 11. This waterbed 11 consists of a foundation 13 of any conventional variety including those incorporating boxsprings. The foundation 13 is supported upon the floor and is adapted to support a watermattress 15.

In the illustrated embodiment, the watermattress 15 is of the hybrid type having a bladder 17 and a foam sidewall 19 extending around the periphery of the bladder. The sidewall 19 includes a top surface 21, a lateral surface 23, and a bottom surface 25. The top surface 21 extends substantially coplaner to the top of the bladder 17, while the lateral surface 23 provides a substantially vertical side for the mattress 15. The bottom surface 25 can be glued to a foam panel 27 which extends over substantially the entire bottom surface of the mattress 15. It follows that the sidewall 19 in combination with the foam panel 27 form a cavity which is adapted to receive bladder 17. This cavity is typically lined with a waterproof liner 29 which extends over the surfaces 21, 23 and 25 of the sidewall 19.

The bottom surface of the foam panel 27 can be releasably adhered to foundation 13 by a strip of hook and loop tape 30.

The bladder 17, sidewall 19, foam panel 27 and liner 29 are enveloped in a mattress cover 31 which includes a top cover 33, a lateral cover 35 and a bottom cover 37. Top cover 33 is preferably joined to the lateral cover 35 by a zipper 39 which provides access to the bladder 17.

Figure 2:
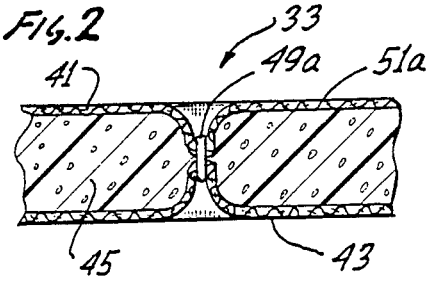
FIG. 2 is a cross-sectional view of the mattress cover taken along lines 2—2 of FIG. 1 and illustrating the attractive loft characteristics effected by fabric of the present invention.

In this embodiment, the top cover 33 is quilted as best illustrated in FIG. 2. This quilting includes a top or outermost fabric which can be imprinted by a heat transfer process. A similar type of fabric without the imprinting, commonly referred to as Greige goods, forms the innermost fabric 43 of the quilted top cover 33. In order to provide loft to the quilting, a layer of urethane foam or polyester fiber 45 is sandwiched between the fabrics 41 and 43. In the preferred embodiment, this layer of foam 45 has a thickness of one inch. It is the stretch and memory characteristics associated with the fabrics 41 and 43 which offer the significant advantages associated with the present invention.

The lateral cover 35 can be formed from the same quilting. However, since the loft, stretch, and memory characteristics are not as significant for the lateral cover 35, the sandwiched foam 45 may be only one quarter inch thick, and the inner fabric 43 may be of a nonwoven, non-stretch material.

The stretch fabric which is adapted for use as the outer fabric 41 and particularly desirable for the inner fabric 43, is of significant importance to the present invention. This fabric is supplied by Culp Ticking of High Point, N.C., and is referred to as "Memory Ticking". The strength characteristics of this material is equal to or exceeds that of conventional damask and polyester knits presently being used for mattress covers. Of particular importance and distinction, however, are the stretch and memory characteristics associated with this fabric. This particular fabric has a stretch characteristic, measured in accordance with the ASTM test D 2594-72, which is 55% along its width and 40% along its length. Its retention characteristics, measured in accordance with the ASTM test D 2594-72, show 94% retention along both length and width after a period of one minute, and 97% retention along its width and length after one hour.

While these particular specifications are significant, the advantages associated with this concept can be achieved with even lesser specifications. Thus a fabric having stretch characteristics measured in accordance with ASTM test D 2594-72, in excess of 20% will significantly reduce the hammock effect associated with present watermattresses. Similarly, stretch characteristics, measured in accordance with the ASTM test D 2594-72, which provide memory retention in excess of 85% would significantly reduce the bunching and wrinkles associated with the fabrics presently used for mattresses.

Figure 3:
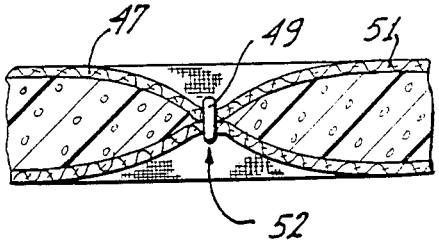
(PRIOR ART) FIG. 3
FIG. 3 is a cross-sectional view similar to FIG. 2 showing a mattress cover of the prior art.

Another characteristic of the mattress cover 31 which is facilitated by this fabric is the very flat and attractive appearance which it provides to the quilting. For comparison, FIG. 3 illustrates a quilting associated with the prior art, which includes a top fabric 47 and stitching 49, which form plateaus 51 and valleys 52. The top fabric 47 does not have the desirable stretch characteristics associated with the fabric 41 of the present invention. As a consequence, the fabric 47 slopes gradually down to the quilt stitching 49 thereby leaving rather deep, wide and noticeable valleys 52 in the quilting. The plateaus 51, where the quilting achieves its maximum loft, tend to have a reduced area so as a whole the quilting does not appear to be very flat.

In comparison, and further reference to FIG. 2, it will be noted that the fabrics 41 and 43 with stretch characteristics, slope abruptly toward the quilt stitching **49*a* so that the plateaus 51*a* occupy a significant area of the quilting. This gives the overall pattern a very flat and pleasing appearance. In a preferred embodiment, with one inch urethane foam 45, it has been found that the plateaus 51*a* occur as close as one-half inch to the stitching 49*a***.

Figure 4:
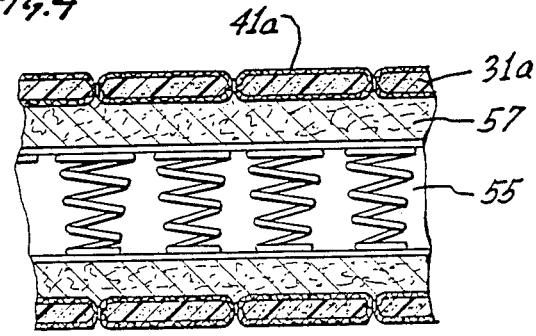
FIG. 4 is a cross-sectional view of a typical boxspring construction including the mattress cover of the present invention.

FIG. 4 illustrates that the concepts of the present invention are equally applicable to innerspring mattresses. Thus a spring assembly 55 can be sandwiched between layers of rag felt 57 and enveloped in a mattress cover **31*a*. Polyester fiber and nylon webbing, (neither shown) can sometimes be found in this innerspring construction. Nevertheless, it is the stretch characteristics and memory characteristics of the top fabric 41*a*** which are particularly desirable for this innerspring mattress construction.

With a description of these preferred embodiments, it will now be apparent to those skilled in the art that this concept can be embodied in many different forms and assemblies. For that reason, the scope of the present invention should be ascertained only with reference to the following claims.

We claim:

1. A watermattress having properties for reducing the "hammock effect" and comprising:

a bladder formed of water impervious sheet material and adapted to be filled with water to support the weight of a person on the mattress;

the bladder having a first shape when the person is not lying on the watermattress and having a second shape when the person is lying on the watermattress;

a quilted mattress cover at least partially enveloping the bladder and including a first fabric, a second fabric, and a layer of polyester foam material stitched therebetween;

indicia heat transfered onto the first fabric;

the first fabric and the second fabric of the mattress cover each having a particular stretch characteristic for expanding to the second shape when the person is lying on the watermattress, and having a particular memory retention characteristic for returning to the first shape when the person is removed from the watermattress; whereby the weight of the person is supported primarily by the desirable flotation effect of the water in the bladder thereby reducing the objectionable "hammock effect" of the watermattress.

2. The watermattress recited in claim 1 wherein the layer of polyester foam material has a thickness of at least one inch.

3. The mattress cited in claim 1 wherein the quilting of the mattress cover defines plateaus where the quilting achieves substantially maximum loft, and valleys in proximity to the stitches, and the plateaus occur within one-half inch of the stitches.

4. The water mattress recited in claim 1 wherein at least one of the first fabric and the second fabric has retention characteristics of at least 85% measurable in accordance with ASTM test D 2594-72 along both its length and width.

5. The watermattress recited in claim 1 wherein the second fabric is disposed in juxtaposition to the bladder.

6. The watermattress recited in claim 1 wherein the particular stretch characteristic is fabric stretch greater than 20% in all directions as measured in accordance with the ASTM Test D 2594-72.

7. The watermattress recited in claim 6 wherein the particular memory retention characteristic is a fabric growth less than 15% after one hour as measured in accordance with the ASTM Test D 2594-72.

8. The watermattress recited in claim 7 wherein the fabric growth is less than 5% after one hour.

9. The watermattress recited in claim 6 wherein the first fabric has a length and a width, and the fabric stretch is at least 55% along the width of the first fabric and at least 40% along the length of the first fabric.

10. A mattress, comprising:

resilient means for supporting a person on the mattress; the resilient means having an original size and shape, characteristics for expanding to a second size and shape under the weight of the person, and properties for returning to substantially the original size and shape after that weight is removed;

a mattress cover at least partially enveloping the resilient means and including portions having the configuration of a quilt;

the quilt including a top fabric, a bottom fabric and a lofting material disposed therebetween;

each of the top fabric and the bottom fabric having stretch characteristics for expanding to the second size and shape, and memory characteristics for returning to substantially the original size and shape of the resilient means; and the memory characteristics of at least one of the top fabric and bottom fabric is a memory retention greater than 85% after one hour when measured in accordance with an ASTM Test D 2594-72.

11. The mattress set forth in claim 10 wherein the memory retention characteristic of at least one of the top fabric and the bottom fabric is greater than 95% after one hour.

12. The mattress recited in claim 10 wherein at least one of the top fabric and bottom fabric under an ASTM test D 2594-72 has a stretch characteristic greater than 20% in all directions.

13. The mattress set forth in claim 12 wherein at least one of the top fabric and the bottom fabric has a stretch characteristic greater than 40% in all directions.

14. The mattress set forth in claim 10 wherein the resilient means includes a bladder adapted to be filled with water for supporting the person on the mattress, and the bottom fabric of the mattress cover is disposed in juxtaposition to the bladder.

15. The mattress recited in claim 10 wherein the resilient means comprises a plurality of metal springs interconnected and compressible under the weight of the person.

16. The mattress set forth in claim 10 wherein the lofting material has a thickness of at least one inch.

17. A watermattress comprising:

a bladder formed of water impervious sheet material and adapted to be filled with water to support the weight of a person on the mattress;

the bladder having a first shape when the person is not lying on the watermattress and having a second shape when the person is lying on the watermattress;

a mattress cover at least partially enveloping the bladder and including a top cover and a lateral cover;

at least the top cover having a fabric stretch characteristic greater than 20% along both its length and width as measured in accordance with an ASTM Test D 2594-72;

at least the top cover having a memory retention characteristic greater than 85% after one hour when measured in accordance with the ASTM Test D 2594-72; whereby at least the top cover is able to stretch from the first shape to the second shape and thereby reduce the "hammock effect" when the weight is on the mattress, and is able to return from the second shape to substantially the first shape in order to reduce the wrinkles in the top cover after the weight is removed from the mattress.

* * * * *